United States Patent [19]

Rodwell

[11] 4,398,603

[45] Aug. 16, 1983

[54] STEAM GENERATION FROM LOW QUALITY FEEDWATER

[75] Inventor: Leonard G. Rodwell, Calgary, Canada

[73] Assignee: Hudson's Bay Oil and Gas Company Limited, Canada

[21] Appl. No.: 223,172

[22] Filed: Jan. 7, 1981

[51] Int. Cl.[3] ..... E21B 43/24; F22B 33/18

[52] U.S. Cl. ..... 166/267; 60/653; 122/1 R; 166/57; 166/303

[58] Field of Search ..... 166/272, 57, 303, 266, 166/267; 122/1 R, 1 C; 210/737, 5.5 A

[56] References Cited

U.S. PATENT DOCUMENTS

| | | | |
|---|---|---|---|
| 2,756,208 | 7/1956 | Axelrad et al. | 210/724 |
| 2,947,689 | 8/1960 | Cain | 210/737 |
| 3,159,145 | 12/1964 | Strohmeyer, Jr. | 122/1 R |
| 3,410,796 | 11/1968 | Hull | 210/737 |
| 3,483,924 | 12/1969 | Blevins et al. | 166/272 |
| 3,881,550 | 5/1975 | Barry | 166/303 X |

FOREIGN PATENT DOCUMENTS 669928 4/1952 United Kingdom .

OTHER PUBLICATIONS

Dec., 1967, Journal of Petroleum Technology, pp. 1537-1540, "The Thermosludge Water Treating and Steam Generation Process".

ERDA Publication No. 10, "Enhanced Recovery of Oil & Gas", pp. 55-57.

Report No. 72 of the First International Conference on the "Future of Heavy Crude & Tar Sands", titled "The Vapor Therm Process for Recovery of Viscous Crude Oil", by F. S. Young, Jr. and R. W. Krajicek.

Esso Process, Application No. 770,866 to the Energy Resources Conservation Board, May, 1978, FIG. 6.30.

*Primary Examiner*—Stephen J. Novosad

*Attorney, Agent, or Firm*—Laney, Dougherty, Hessin & Beavers

[57] ABSTRACT

Steam is produced from low quality feedwater. A feedwater stream and a superheated steam stream are introduced into a contactor vessel where the superheated steam is contacted with the feedwater thereby producing saturated steam in the contactor vessel and precipitating minerals from the feedwater in the contactor vessel. The produced steam is withdrawn from the contactor vessel and divided into a primary stream and a secondary stream. The primary stream of produced steam is flowed to a use terminal such as a well for injecting the same into a subsurface formation as part of a steam flood system or such as a steam turbine. The secondary stream of steam is superheated and recycled to the contactor vessel. Waste water containing the solid minerals precipitated from the feedwater within the contactor vessel is withdrawn from the contactor vessel through a waste water discharge conduit.

28 Claims, 2 Drawing Figures

STEAM GENERATION FROM LOW QUALITY FEEDWATER

BACKGROUND OF THE INVENTION

1. Field of the Invention

The present invention relates generally to apparatus and methods for producing steam, and more particularly, but not by way of limitation, to apparatus and methods for producing steam from low quality feedwater including oily saline water produced from an underground oil and gas production zone.

2. Description of the Prior Art

One manner of stimulating the production of hydrocarbons from subsurface formations is to inject steam into the subsurface formation. An oil production operation based on such steam injection normally requires a source of high quality feedwater for steam generation and also requires a means for disposing of oily saline produced water which is recovered from the formation along with the hydrocarbons.

In some areas, however, a reliable supply of high quality feedwater is not readily available, and it is, therefore, desirable to recycle oily saline produced water and utilize the same to generate steam to be injected back into the underground formation.

Several prior art systems have provided means for generating steam from low quality feedwater or otherwise relate to some part of the steam production system of the present invention as described below.

U.S. Pat. No. 2,947,689 to Cain discloses a process and system for generating hot processed water from feedwater having scale forming salts therein. As illustrated in the figure of the Cain disclosure, that reference discloses a process wherein low quality feedwater 14 is charged to a heating tower 10 first contacting hot flue gas from a superheater, then hot gases from a burner 16, precipitating out sludge at 17. The heated water is acidified and pumped by pump 21 to heating vessel 20 by outlet 24. Steam from heating vessel 20 exits by outlet 26 and is preheated by an exchanger 31 in superheater 29 prior to pressuring up by compressor 33 and superheating in exchanger 34 in superheater 29. The superheated steam produced thereby flows from line 25 to heater 20 to form more steam, exiting by line 26, by a gas liquid contact with the water in heater 20. This process differs substantially from the present invention in that it produces hot water rather than steam.

British Pat. No. 669,928 discloses a system for making distilled water from low quality water such as sea water. Sea water enters pre-heater 4 by inlet 3 and is heated by way of a gas liquid interface by superheated steam entering by inlets 5. Sludge from scaling minerals is disposed of by outlet 6. The heated brine then passes through a distillation process and a portion of the steam generated during that distillation process is superheated in superheater 21 and recycled to the preheater 4 by the outlets 5.

U.S. Pat. No. 3,410,796 to Hull and an article entitled "The Thermosludge Water Treating and Steam Generation Process" from the December, 1967 of the *Journal of Petroleum Technology* at pages 1537–1540 thereof, describe a process generally referred to as the "thermosludge" process. Referring to the Hull patent, low quality feedwater enters the system by line 12 and scaling elements are removed as sludge from water feed tank 10 which is heated by recycled steam from line 40. Hot feedwater having much of the mineral content thereof removed passes by line 14 to stripper 24, and is treated with sulfite and amine on the way. Steam is generated by line 26, from stripper 24, which conducts the produced steam to the point of use thereof. Blowdown from the stripper 24 and steam drum 30 passes by outlet 34 through a low pressure separator 38 which drops out more sludge of precipitated minerals by means of line 42, and which passes the steam content of the blowdown to the water feed tank 10 by line 40. The stripper 24 and steam drum 30 are heated by a thermosiphon system wherein water passes by line 32 to a steam chest where a heat exchanger 44 transmits heat to the steam from a molten salt circuit. Although the system illustrated in the Hull reference does produce steam as opposed to merely producing water, its manner of doing so is such that the heat exchanger tubes within the heaters are in contact with hard water and scaling is a problem as is disclosed in column 6, lines 48–56 of the Hull patent.

U.S. Pat. No. 2,756,208 to Axelrad et al. discloses a process for producing hot water utilizing high pressure steam from a conventional boiler to contact water and heat the same.

Another prior art process generally known as the "vapor therm process" is described in ERDA publication No. 10 entitled "Enhanced Recovery of Oil and Gas" at pages 55–57 thereof, and is also described in Report Number 72 of the "First International Conference on the Future of Heavy Crude and Tar Sands", entitled "The Vapor Therm Process for Recovery of Viscous Crude Oil" by F. S. Young, Jr. and R. W. Krajicek. The vapor therm process includes a high pressure air compressor, a high pressure combustion chamber, a water chamber, a water injection and blowdown drum and related pumps and instrumentation. The high pressure combustion gas is contacted with low quality feedwater to generate steam. The mixture of steam and combustion gases is then injected into the wells to perform the flooding operation. Blowdown water including precipitated mineral solids is withdrawn from the contactor.

Another prior art process developed by Esso Resources and described in Application No. 770866 to the Energy Resources Conservation Board, May 1978, includes the generation of superheated steam in a utility type boiler and the subsequently blending of the superheated steam with heated produced brine. Approximately one barrel of high quality water is required for each barrel of saline water to be recycled. The saturated steam generated by the blending of the superheated steam with produced brine is then injected in the subsurface formation.

SUMMARY OF THE INVENTION

By the present invention, a low quality feedwater stream is introduced into a contactor vessel. Superheated steam is also introduced into the contactor vessel and contacted with the feedwater to thereby produce saturated steam in the contactor vessel and to precipitate minerals from the feedwater in the contactor vessel. The precipitated minerals are removed from the contactor vessel by withdrawing a waste water stream containing said minerals from the contactor vessel.

If saturated steam is required at a use terminal, the saturated steam is withdrawn from the contactor vessel and divided into a primary and secondary stream. The primary stream is then flowed to the use terminal, which may be an injection well in a steam flooding system for a subsurface hydrocarbon producing formation. The secondary stream is directed to a steam compressor from which it is directed to a superheater. The superheated secondary stream of steam is then recycled to the contactor vessel.

If superheated steam is required at the use terminal, the saturated steam is withdrawn from the contactor vessel and directed to the steam compressor and then to the superheater. Superheated steam from the superheater is then divided into a primary stream and a secondary stream. The primary stream is flowed to the use terminal, which may be a steam powered generator. The secondary stream is recycled to the contactor vessel.

A general object of the present invention is the provision of apparatus and methods for producing steam.

Another object of the present invention is the provision of apparatus and methods for producing steam from low quality feedwater such as oily saline produced water or boiler blowdown water.

And another object of the present invention is the provision of improved apparatus and methods for steam flooding a subsurface hydrocarbon formation by recycling oily saline produced water.

Yet another object of the present invention is the provision of improved apparatus and methods for generating power with a steam powered generation device.

And another object of the present invention is the provision of apparatus and methods for producing steam from low quality feedwater while avoiding problems of scaling of heat exchangers by utilizing a gas-liquid contact for steam generation.

Yet another object of the present invention is the provision of apparatus and methods for generating steam from low quality feedwater, and removing precipitated minerals from a steam-feedwater contacting vessel.

And another object of the present invention is the provision of apparatus and methods for initially starting a steam generation system which ultimately relies on recycled superheated steam for the generation of saturated steam produced by the system.

Numerous other objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

STEAM INJECTED WELLS

Figure 1:
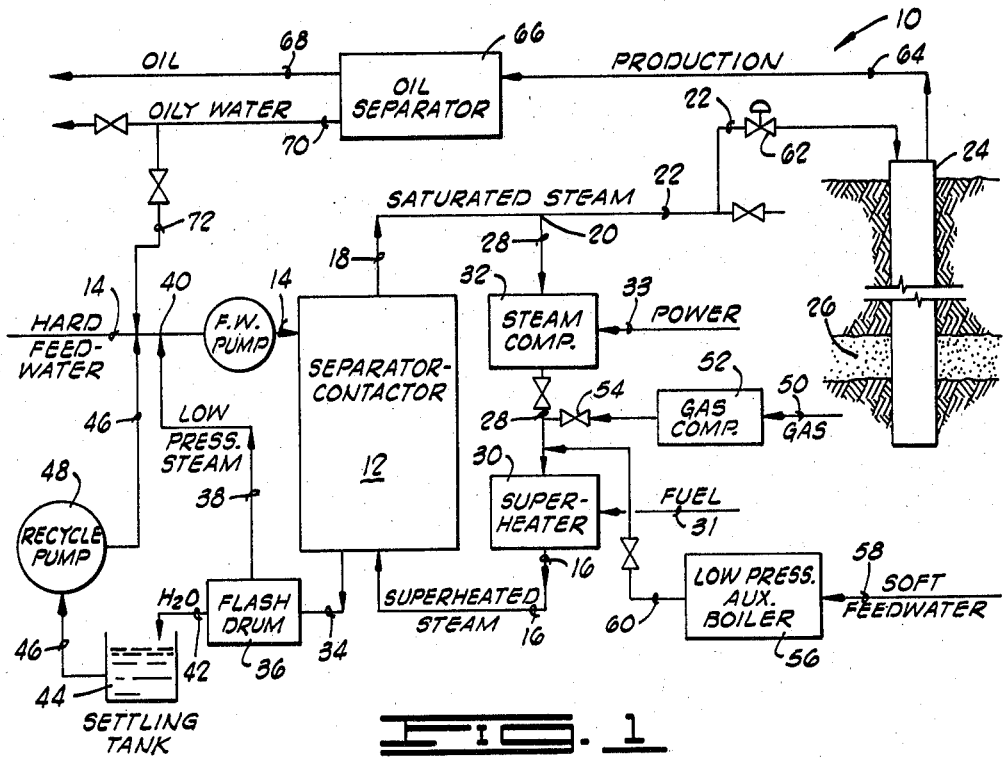
FIG. 1 is a schematic block diagram of the steam generation system of the present invention illustrating the same being utilized to steam flood a subsurface hydrocarbon producing formation.

Referring now to the drawings, and particularly to FIG. 1, the steam production system of the present invention is shown and generally designated by the numeral 10. The steam production system 10 includes a separator-contactor 12, which may generally be referred to as a contactor vessel 12.

The contactor vessel 12 provides a means for contacting feedwater and superheated steam to produce saturated steam and waste water. The waste water contains mineral solids precipitated from the feedwater.

Low quality or hard feedwater is introduced to the separator vessel 12 by a first conduit 14, which may be referred to as an inlet conduit means.

Superheated steam is introduced to the contactor vessel 12 by a second conduit 16, which may be referred to as a recycle conduit means.

A third conduit 18 withdraws saturated steam from the contactor vessel 12 and carries the same to a conduit junction 20 which may generally be referred to as a divider means 20 for dividing the saturated steam from third conduit 18 into a primary stream and a secondary stream. A fourth conduit 22, which may be referred to as a flow conduit means, is connected to a well 24 and the first stream of saturated steam flows through conduit 22 to the well 24 where the same is used for flooding a subsurface hydrocarbon producing formation 26.

A fifth conduit 28 directs the secondary stream of saturated steam from divider means 20 to a superheater 30. Connected within fifth conduit 28 is a low compression ratio steam compressor 32. Third and fifth conduits 18 and 28 may be collectively referred to as an outlet conduit means for withdrawing saturated steam from vessel 12 and conducting at least a portion of the same to superheater 30.

It will be appreciated by those skilled in the art that the relative positions of compressor 32 and superheater 30 could be reversed. In many situations the most suitable configuration is to install compressor 32 between two superheaters.

An outlet of the superheater 30 is connected to second conduit 16 for recycling the superheated second stream of steam to the contactor vessel 12 where the process repeats itself.

A sixth conduit 34, which may be referred to as a waste conduit, provides a means for removing precipitated minerals from the contactor vessel 12 by withdrawing a waste water stream containing said minerals from the contactor vessel 12.

Example

An example of the basic steam generation system of FIG. 1 for producing 25 million BTU's per hour at 500 psig through flow conduit 22 to the well 24 is given in the following Table 1. The various fluid streams are indicated by the numbers of the conduits through which they flow. Fuel and power inputs to superheater 30 and compressor 32 are indicated schematically by energy input streams 31 and 33, respectively.

TABLE I

APPROXIMATE ENERGY AND MATERIAL BALANCE FOR A RECYCLE STEAM GENERATOR 25 MMBtu/hr. OUTPUT AT 500 Psia

| Stream | Description | Temp °F. | Pressure Psia | Rate 1,000 lb/hr | Enthalpy Btu/lb | Total Enthalpy MMBtu/hr |
|---|---|---|---|---|---|---|
| 14 | Cold Feed | 50 | 500 | 23.1 | 18 | 0.4 |
| 18 | Sat. Vapor | 467 | 500 | 144.1 | 1204.4 | 173.6 |
| 22 | Sat. Vapor | 467 | 500 | 20.8 | 1204.4 | 25.0 |
| 28 | Sat. Vapor | 470 | 515 | 123.3 | 1204.3 | 148.5 |
| 16 | Superheated | 800 | 500 | 123.3 | 1412.1 | 174.2 |
| 34 | Sat. Liquid | 467 | 500 | 2.3 | 449 | 1.0* |
| 31 | Fuel | | | 2.0** | 16000 | 32.1 |
| 33 | Power (diesel) | 225 HP | | .1*** | 18000 | 2.0 |

*60% can be recovered by flashing, to heat feedwater.
**at 80% heat efficiency
***at 0.5 lbs/HP hour.

AUXILIARY EQUIPMENT

Referring again to FIG. 1, the various auxiliary equipment connected to the main power generation system just described will now be described.

The waste water withdrawn from contactor vessel 12 through conduit 34 is directed to a flash drum 36 where it is flashed to approximately atmospheric pressure. Low pressure steam created in flash drum 36 is directed by conduit 38 to a junction 40 with inlet 14 for pre-heating the feedwater inlet stream in conduit 14.

Water carrying precipitated mineral solids is directed through a conduit 42 to a settling tank 44 where the solid materials are separated from the water. Water from settling tank 44 may be recycled by a conduit 46 and a recycle pump 48 disposed therein to the feedwater inlet stream in conduit 14.

The feedwater stream in conduit 14 is pumped to vessel 12 by a feedwater pump 49.

One problem which may be encountered with a system like that shown in FIG. 1 is that superheated steam is required to produce saturated steam and once the system is on line, the superheated steam itself is produced from the saturated steam. Therefore, upon initially starting up the system, there is no saturated steam with which to produce superheated steam from the normal recycle process.

This problem may be overcome in several ways.

One manner is to utilize air, nitrogen, or some other suitable gas, the input of which is represented at conduit 50, which is pumped by compressor 52 into the superheater 30 which may be utilized to heat the gas. The use of nitrogen is preferrable for corrosion protection. The heated gas is then introduced to the contactor vessel 12 through conduit 16 and generates steam within the contactor vessel 12. Subsequently, after sufficient steam is being generated in the contactor vessel 12 so that adequate amounts thereof may be recycled to conduit 28 and through superheater 30, the gas supply may be cut off by closing valve 54 thereby replacing the step of heating gas with the desired superheating of the secondary stream of steam.

Another manner of overcoming the problem of providing initial startup steam is to provide a conventional low pressure auxiliary boiler 56 to which a smaller supply of soft feedwater is provided by conduit 58. The steam generated in boiler 56 may then be fed to superheater 30 by conduit 60. Again, once sufficient saturated steam is being generated in contactor vessel 12 to provide adequate amounts of steam in the recycle line 28, the auxiliary boiler 56 may be shut down.

With the system shown in FIG. 1, the primary stream of produced saturated steam is directed to well 24 by conduit 22 as previously mentioned. A pressure regulating means 62 within conduit 22 regulates the pressure of steam being injected into the well.

A mixture of hydrocarbons and oily saline produced water is produced from well 24 by production line 64, which may be referred to as a production conduit means. It is directed by production line 64 to an oil separator 66 from which an oil line 68 carries the liquid hydrocarbon and from which an oily water line 70 conducts the oily saline produced water. The oily saline produced water may be recycled from conduit 70 to feedwater line 14 by a production recycle conduit 72.

STEAM DRIVEN POWER GENERATOR

Figure 2:
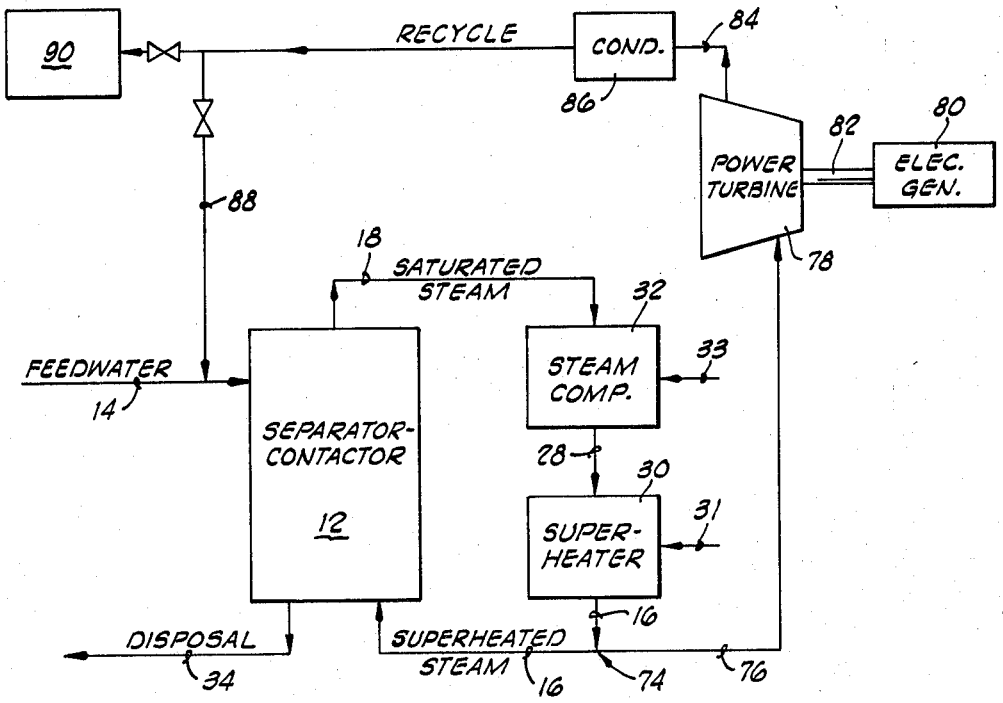
FIG. 2 is a simplified schematic block diagram of the steam generation system of the present invention, illustrating the same being utilized to produce superheated steam for powering a steam powered generating system.

Referring now to FIG. 2 the main power generation system of the present invention is again shown, in a slightly modified form from that of FIG. 1, being adapted for the production of superheated steam rather than saturated steam.

In the embodiment of FIG. 2, the outlet conduit 18 directs all of the saturated steam produced by vessel 12 to compressor 32, from which the produced steam flows through conduit 28 to superheater 30.

The recycle conduit 16 includes a divider means 74, which is a junction with a superheated steam flow conduit 76, for dividing the superheated steam from superheater 30 into a primary stream and a secondary stream.

Flow conduit 76 flows the primary stream of superheated produced steam to a power turbine 78, which may be generally refrred to as a use terminal.

Recycle conduit 16 recycles the secondary stream of superheated produced steam to vessel 12.

Turbine 78 drives an electric generator 80 through a shaft 82. Low pressure steam exits turbine 78 by conduit 84 to a condensor 86. High quality water discharged from condensor 86 may either be recycled to feedwater stream 14 through a discharge recycle conduit 88 or it may be directed to a process zone 90 requiring high quality feedwater.

All the various auxiliary equipment shown in FIG. 1 may also be used with the modified equipment in FIG. 2.

The divider means 74 and superheated steam flow conduit 76 could also be added to the system of FIG. 1 so that one system could produce both saturated and superheated steam for use at one or two use terminals.

Thus it is seen that the apparatus and methods for producing steam from low quality feedwater of the present invention are readily adapted to achieve the ends and advantages mentioned as well as those inherent therein. While presently preferred embodiments of the invention have been illustrated and described for the purpose of this disclosure, numerous changes in the arrangement and construction of parts may be made by those skilled in the art which changes are encompassed within the scope and spirit of this invention as defined by the appended claims.

I claim:

1. A method of producing steam, comprising:

(a) introducing a feedwater stream into a contactor vessel;

(b) introducing superheated steam into said contactor vessel; thereby (c) contacting said superheated steam with said feedwater; thereby (d) producing saturated produced steam in said contactor vessel and precipitating minerals from said feedwater in said contactor vessel;

(e) superheating at least a portion of said produced steam in a superheater thereby generating additional superheated steam;

(f) recycling at least a portion of said additional superheated steam to said contactor vessel; and (g) flowing another portion of said produced steam to a well, and introducing said other portion of said produced steam into said well to steam flood an underground formation intersected by said well.

2. The method of claim 1, wherein:

said step (g) is further characterized as dividing said saturated produced steam into a primary stream and a secondary stream upstream of said superheater, and flowing said primary stream of saturated produced steam to said well;

said step (e) is further characterized as superheating said secondary stream of produced steam in said superheater; and said step (f) is further characterized as recycling said superheated secondary stream of produced steam to said contactor vessel.

3. The method of claim 2, further comprising:

compressing said secondary stream of steam.

4. The method of claim 3, wherein:

said compressing of said secondary stream of steam occurs upstream of said superheater.

5. The method of claim 2, further comprising:

removing said precipitated minerals from said contactor vessel by withdrawing a waste water stream containing said minerals from said contactor vessel.

6. The method of claim 5, further comprising:

flashing said waste water stream to produce low pressure steam; and preheating said feedwater stream with said low pressure steam.

7. The method of claim 5, further comprising:

separating said precipitated minerals from said waste water stream; and recycling said waste water stream to said feedwater stream.

8. The method of claim 2, further comprising:

initially starting said method by heating a gas and introducing said heated gas into said contactor vessel thereby contacting said heated gas with said feedwater to produce steam in said contactor vessel; and subsequently replacing said step of heating gas with said step of superheating said secondary stream of steam.

9. The method of claim 8, wherein:

said initial starting step is further characterized in that said gas is air.

10. The method of claim 8, wherein:

said initial starting step is further characterized in that said gas is nitrogen.

11. The method of claim 2, further comprising:

initially starting said method by generating low pressure stream in a low pressure auxiliary boiler and superheating said low pressure steam; and introducing said low pressure steam into said contactor vessel.

12. The method of claim 1, further comprising:

separating produced water from a production stream from said underground formation; and recycling said produced water into said feedwater stream.

13. The method of claim 1, wherein:

said step (g) is further characterized as dividing said additional superheated steam generated in step (e) into a primary stream and a secondary stream downstream of said superheater, and flowing said primary stream of superheated produced steam to said well.

14. A steam production system, comprising:

contactor vessel means for contacting feedwater and superheated steam to produce saturated produced steam and waste water containing precipitated minerals;

superheater means for superheating produced steam received from said contactor vessel means and thereby generating additional superheated steam;

inlet conduit means for introducing said feedwater into said contactor vessel means;

recycle conduit means for recycling at least a portion of said additional superheated steam to said contactor vessel means;

outlet conduit means for withdrawing said saturated produced steam from said contactor vessel means and conducting at least a portion of said saturated produced steam to said superheater means; and flow conduit means for flowing another portion of said produced steam to a well and thus to an underground formation intersected by said well.

15. The system of claim 14, wherein:

said outlet conduit means includes a divider means for dividing said saturated produced steam into a primary stream and a secondary stream, and said outlet conduit means is further characterized as a means for conducting said secondary stream of saturated produced steam to said superheater means; and said flow conduit means is connected to said outlet means at said divider means and is further characterized as a means for flowing said primary stream of saturated produced steam to said well.

16. The system of claim 15, wherein:

said recycle conduit means is further characterized as a means for recycling said superheated secondary stream of produced steam to said contactor vessel means.

17. The system of claim 15, further comprising:

a steam compressor means for compressing said secondary stream of produced steam.

18. The system of claim 17, wherein:

said steam compressor means is connected to said outlet conduit means upstream of said superheater means.

19. The system of claim 18, wherein:

said steam compressor means is downstream of said divider means.

20. The system of claim 14, further comprising:

production conduit means for flowing a production stream from said underground formation;

separator means, connected to said production conduit means, for separating water from said production stream; and production recycle conduit means for recycling said water from said separator means to said feedwater.

21. The system of claim 14, further comprising:

waste conduit means for removing said precipitated minerals from said contactor vessel means by withdrawing a waste water stream containing said minerals from said contactor vessel means.

22. The system of claim 21, further comprising:

flash means, connected to said waste conduit means, for flashing said waste water stream to produce low pressure steam; and preheat means for preheating said feedwater with said low pressure steam from said flash means.

23. The system of claim 21, further comprising:

separator means, connected to said waste conduit means, for separating said precipitated minerals from said waste water stream; and waste recycle means for recycling said waste water stream to said feedwater.

24. The system of claim 14, further comprising:

start-up means for introducing heated gas into said contactor vessel means to initially generate steam in said contactor vessel means.

25. The system of claim 24, wherein:

said heated gas is heated air.

26. The system of claim 24, wherein:

said heated gas is heated nitrogen.

27. The system of claim 14, further comprising:

an auxiliary boiler means for generating low pressure steam and introducing said low pressure steam into said superheater means to start-up said system.

28. The system of claim 14, wherein:

said recycle conduit means includes a divider means for dividing said superheated steam from said superheater means into a primary stream and a secondary stream, and said recycle conduit means is further characterized as means for recycling said secondary stream of superheated produced steam to said contactor vessel means; and said flow conduit means is connected to said recycle conduit means at said divider means and is further characterized as a means for flowing said primary stream of superheated produced steam to said well.

* * * * *

UNITED STATES PATENT AND TRADEMARK OFFICE

CERTIFICATE OF CORRECTION

PATENT NO. : 4,398,603

DATED : August 16, 1983

INVENTOR(S) : Leonard G. Rodwell

It is certified that error appears in the above-identified patent and that said Letters Patent is hereby corrected as shown below:

Column 8, line 12, Claim 11, "stream" should read -- steam --

Signed and Sealed this

*Third* Day of *January 1984*

[SEAL]

*Attest:*

GERALD J. MOSSINGHOFF

*Attesting Officer*

*Commissioner of Patents and Trademarks*